United States Patent [19]

Howells

[11] Patent Number: 4,959,931

[45] Date of Patent: Oct. 2, 1990

[54] METHOD AND APPARATUS FOR PREVENTING BINDING AND OVERLOADING OF MEDIA FEED SCREW CONVEYOR

[75] Inventor: Roger A. Howells, Orefield, Pa.

[73] Assignee: Air Products and Chemicals, Inc., Allentown, Pa.

[21] Appl. No.: 412,960

[22] Filed: Sep. 26, 1989

[51] Int. Cl.[5] ..... B24C 7/00

[52] U.S. Cl. ..... 51/436; 51/263; 51/438

[58] Field of Search ..... 51/436, 263, 438; 222/558; 198/532, 548, 566, 559

[56] References Cited

U.S. PATENT DOCUMENTS

| | | | |
|---|---|---|---|
| 1,649,941 | 11/1927 | Winsor, Jr. | 222/558 |
| 2,100,937 | 11/1937 | Bowe | 198/548 |
| 2,507,873 | 5/1950 | Ward | 198/532 |
| 4,462,520 | 7/1984 | Strehlow | 198/532 |
| 4,524,550 | 6/1985 | Burke et al. | 51/424 |
| 4,529,085 | 7/1985 | Johnson | 198/532 |
| 4,848,534 | 7/1989 | Sandwall | 198/532 |

*Primary Examiner*—William E. Terrell
*Assistant Examiner*—Mark F. Frazier
*Attorney, Agent, or Firm*—James C. Simmons; William F. Marsh

[57] ABSTRACT

A method and apparatus for preventing binding and overloading of feed augers or screws used to convey blast media (e.g. shot, pellets or irregular shaped particles) from a media storage hopper to a media blasting device. The invention includes a damper to close off media to the screws and a method for controlling start-up and shut down of the media blast system.

1 Claim, 2 Drawing Sheets

METHOD AND APPARATUS FOR PREVENTING BINDING AND OVERLOADING OF MEDIA FEED SCREW CONVEYOR

TECHNICAL FIELD

The present invention pertains to shot-blasting or blast cleaning of surfaces that have been coated, such as by painting. In particular, the present invention is concerned with recycling of and conveying blast media to the blast treating chamber.

BACKGROUND OF THE INVENTION

U.S. Pat. No. 4,524,550 discloses and claims an apparatus for removing flash from molded plastic and elastomeric articles and paint or coatings from various articles by contacting the articles with a blast media entrained in a cold carrier gas. The process operates by using the cold carrier gas, usually at cryogenic temperatures, to embrittle the flash or coating on the articles. The embrittled flash or coating being removed by the impact of the entrained solid particles which are in the form of shot, pellets, or irregular shaped particles. In one particular process, generally referred to a Cyrogenic Coating Removal (CCR) hangers used on a paint line in a manufacturing operation eventually become coated with many layers of paint which have to be removed. By placing these hangers in a device, such as shown in the '550 patent and having the hanger contacted by a particulate material (e.g., polycarbonate plastic) entrained in a nitrogen gas maintained at a temperature of −150° F. to −225° F. (−101° C. to −143° C.), the layers of paint can be embrittled and removed.

In the device of the '550 patent, the blasting particles, or blast media as they are sometimes called, and the coating or flash are collected in the bottom of the device, and removed from the device by a sweep for cleaning and recycling. The blast media is returned via a conveyor to a separator where it is separated from the flash or coating and collected in a storage hopper. The storage hopper, in turn, is connected via an auger or screw feed conveyor to the blasting apparatus or media blasting device for returning the blast media for reuse.

The problem with using an auger usually disposed at the bottom of the feed hopper, is that when the auger is stopped the blast media can and will settle into the screw conveyor, and when the screw conveyor is reactivated to restart the blasting cycle, the screw conveyor or augers, if there are more than one, will bind and will not drive.

At present, in order to avoid this problem, the operator of the device must keep the blast media level at a minimum while allowing full feed to the media throwing wheels in the blast or media treating chamber. This practice will tend to prevent overloading or binding of the augers or screw conveyor on restart after the media blasting device is turned off or the cycle interrupted.

SUMMARY OF THE INVENTION

The present invention is an improvement to an accessory for the device shown in U.S. Pat. No. 4,524,550. The accessory is a blast media storage device which returns blast media to the media blasting chamber, shown in the '550 patent. The media storage device is generally a hopper having a top for a charging the blast media and a bottom which is coupled to an auger or screw feed mechanism, which is used to actually return the blast media to the media blasting chamber. The present invention provides a baffle with an aperture proximate the location in the hopper where the blast media is feed to the conveyor or media screw feed device. The baffle includes an aperture which can be opened or closed by a pneumatically actuated damper to prevent blast media from entering the auger or screw feed device. The damper is operated in a manner so that when the media blasting process is stopped and the auger or screw feed devices are stopped the damper closes off the supply of blast media to the auger. In the method of the invention, the augers are permitted to run after the damper closes so that they are completely cleaned of media to prevent the media from settling into the auger or screw feed and binding of the device when restarted for the next media blasting cycle. The apparatus of the invention can also be operated to delay opening of the damper upon beginning of a subsequent blasting cycle in order to permit the auger or feed screw to reach operating speed.

DETAILED DESCRIPTION OF THE INVENTION

Figure 1:
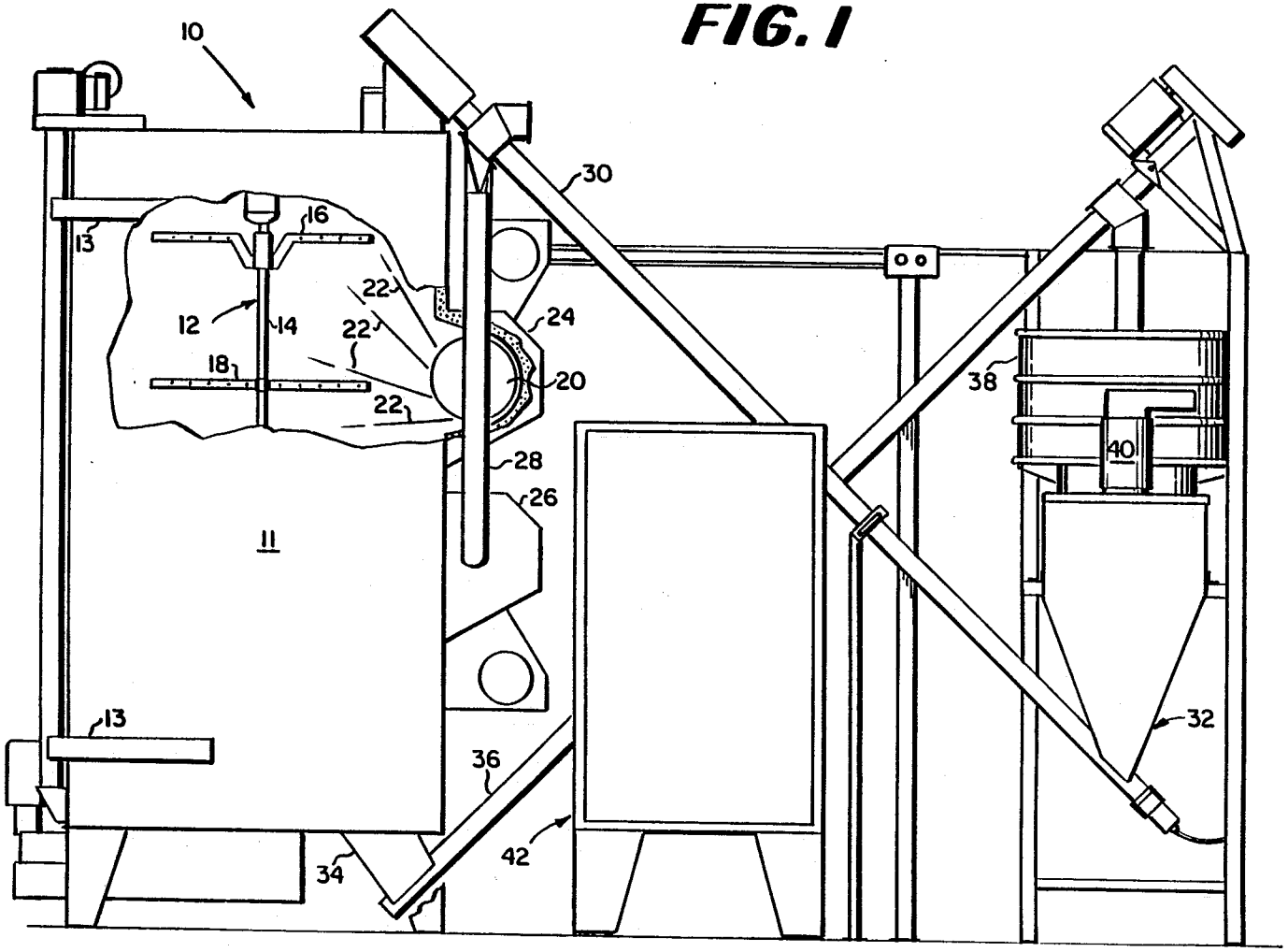
FIG. 1 is a front elevational view of a media blasting system for which the pertains.

Referring to drawing and in particular to FIG. 1, numeral 10 denotes a media blast treating chamber, such as disclosed and claimed in U.S. Pat. No. 4,524.550, the specification and drawing thereof being incorporated herein by the reference. A blast treating chamber 10 includes a central apparatus 12 having a shaft 14 and arms 16, and 18 for receiving articles to be blast treated by the media. Arms 16 and 18 can be adapted to receive hangers used on paint lines in various industrial environments or other types of articles which can be cleaned by a cryogenic shot blasting or cryogenic blast cleaning technique. Chamber 10 includes a pair of blasting wheels, one of which is shown at 20 to propel the blast media toward the arms 16 and 18 as shown by the lines 22. A second throwing wheel (not shown) is contained in the housing 26 which is identical to the housing 24 enclosing media blast wheel 20. Housings 24 and 26 are connected to a media supply tube or conduit 28 to supply the blast media to the wheels. Media supply tube or pipe 28 is in turn connected to a media auger or feed screw conveyor 30 which is in turn connected to the bottom of a media feed hopper 32. Spent media, after it has impacted the devices on arms 16, 18 and the removed coating drop to the bottom of the blast media chamber 10 and are removed via a chute 34 and deposited in an auger or screw conveyor 36 which conducts the spent media and removed particles (e.g. paint or coatings) to a cleaning device such as vibratory separator 38 whereby the blast media is separated from the removed coating and returned to the feed hopper 32 via a conduit 40. Blast treating chamber 10 is fabricated from a metal such as stainless steel and is thoroughly insulated since the device uses a gas (e.g. nitrogen) at a temperature of between −150° F. and −225° F. (−101° C. to −143° C). to embrittle the coating to facilitate removal by the blast media (polycarbonate resin). Blast media chamber 10 includes a large access door 11 with suitable hinges 13 to permit access to the interior of the blast treating chamber for cleaning as well as for installing and removing parts to be cleaned. The system of FIG. 1 includes a suitable control console 42 to permit automatic operation of the device. Control console 42 includes all of the necessary switches indicators relays and electrical wiring to provide safety interlocks and to automatically sequence operation of the various devices so that when the blast media throwing wheel 20 is stopped, feed to the throwing wheels is also terminated and the recycle of the material from the bottom of the blast treat chamber 10 can be continued to clean out the chamber or cabinet 10. Safety interlocks can be included to prevent opening of the door 11 until all conveyors, throwing wheels, rotating hangers, and the like have stopped moving to prevent operator injury.

The system of FIG. 1 includes all the necessary structural supporting members to position the various parts in relation to each other and at the proper heights so that the materials can be conveyed in the most efficient manner between the blast treating chamber 10 and the media recovery and storage devices 38 32.

Figure 2:
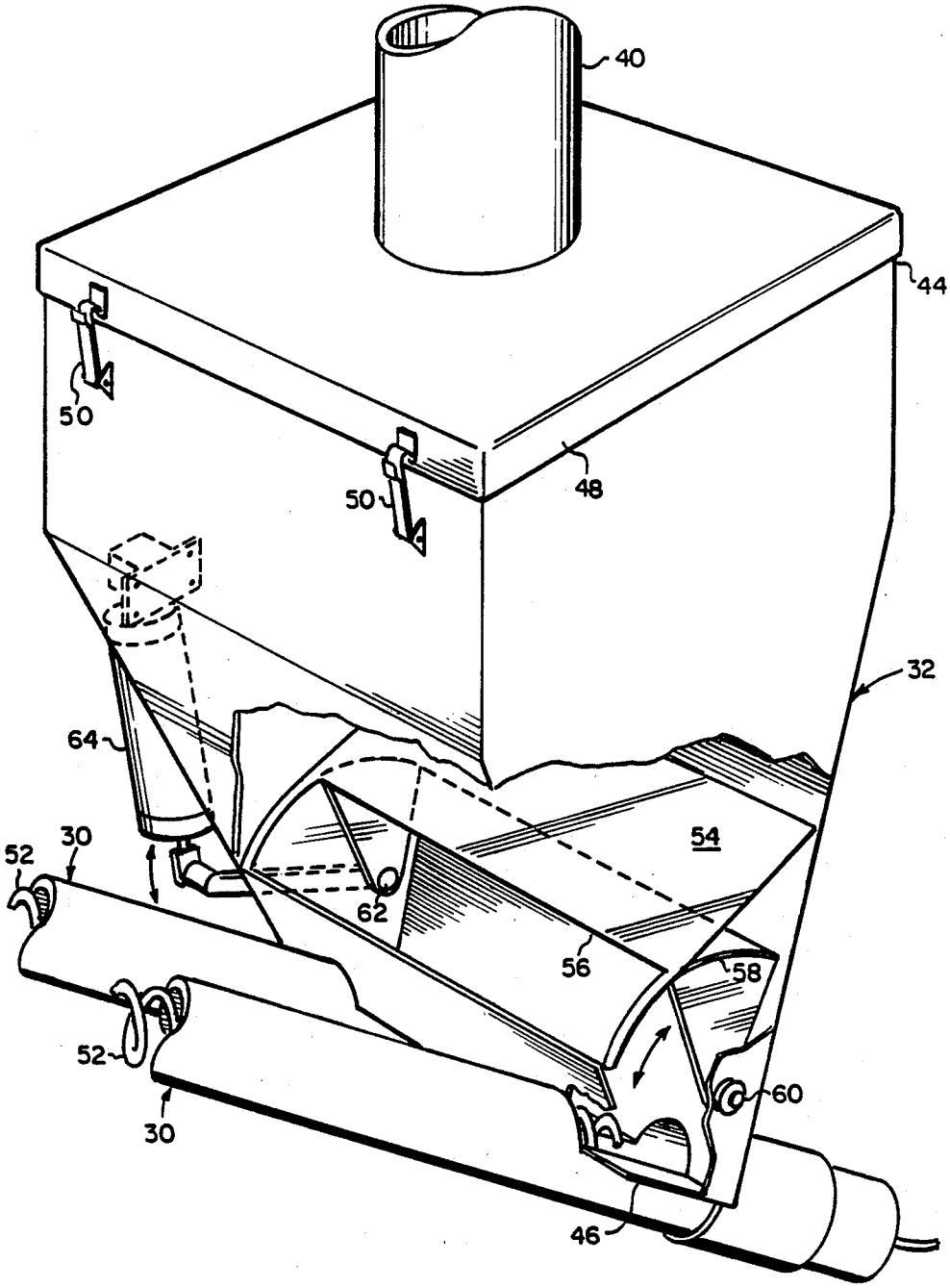
FIG. 2 s an enlarged isometric view of the feed hopper of the device of FIG. 1 with portions broken away to show interior details thereof.

Referring to FIG. 2 there is enlarged detail of the hopper 32 of FIG. 1. Hopper 32 includes a first end 44 and a second end 46. Hopper 32 has a general cross-sectional shape of a rectangle in the portion extending from the first end 44 toward the second end 46. The rectangular portion gently blends into a second portion having a cross-sectional shape of a trapezoid, the second section terminating at the second end 46 of hopper 32. The first end 44 of the hopper 32 is fitted with a cover 4B which is adapted to be opened during periods when the machinery is not running, so that an operator can manually add blast media. Cover 48 is also adapted to receive return conduit 40 so that previously used and cleaned blast media is returned to the hopper 32. Hopper 32 and cover 44 include suitable latching devices 50 to securely position the cover 48 to the hopper 32.

The second end 46 of hopper 32 is adapted to mate with at least one but preferably a plurality of feed augers or feed screw conveyors 30 to permit feeding of blast media to the throwing wheels 20 of blast media chamber 10 as shown in FIG. 1. The bottom of 46 of hopper 32 is constructed so that the media falls directly on the augers or screws 52. In the prior art devices when the media blasting chamber had completed its cycle, and all of the machinery was turned off, blast media contained in hopper 32 was permitted to settle into the augers or feed screws 52 and could bind the augers or feed screws 52 when the machinery was restarted. The way that this problem was dealt with in the past was to control to a precise level the amount of media that was permitted to be stored in hopper 32 during operation and to empty the media hopper after daily operation. This presents a great deal of problems and is costly to the operator since such operations are labor intense.

In order to overcome the problem, according to the present invention a baffle 54 is installed in hopper 32 proximate the second end 46, the baffle containing a full width generally rectangular shaped aperture 56. The aperture 56 can be closed off by the damper 58 which is mounted through a pair of pivots 60, 62 to the outside of the hopper 32 as shown in FIG. 2. Damper 58 can be moved from the position shown in the drawing to close off the aperture 56 by actuating the pneumatic actuating device 64. Pneumatic actuator 64 is a cylinder which can be controlled by an electrical actuating device.

When the system of FIGS. 1 and 2 is in operation the media can be charged to the feed hopper 32 with the damper 58 positioned to close off the aperture 56. When the blasting wheels 20 are actuated and the feed augers or screws 52 actuated the damper can be opened to permit media to be feed to the augers or screws 52. If the cycle of blasting in blast media chamber 10 is interrupted the damper 58 can be moved into position to close off the aperture 56 thereby preventing further media from dropping into the feed augers or screws 52. Upon reactivation of the blasting wheels the baffle can be moved to the position shown in FIG. 2 and once again permit feeding of blast media to the augers or screws 52.

On termination of the operation, either on an intermittent or a long term basis, the damper 58 can be moved into position to close the aperture 56 and the feed augers or screws 52 can be operated for a short period of time to clean all of the residual blast media from the augers or screws to prevent overloading or binding of the augers or screws on the next start-up cycle.

Thus, according to the invention the use of the damper to close off the media supply to the screw conveyor inlets at the bottom of the media storage hopper will prevent feed conveyor start overload which according to the prior art has been controlled by operating the storage hopper only partially full resulting in a marginal volume of media being delivered to the media blast wheels or to manually empty the storage hopper whenever there is a longer than standard cycle delay between operations to prevent settling of the media and binding of the feed screws on restart.

According to the present invention, the feed auger or screws can be operated for a preset time after the blast media cycle is stopped to allow them to empty. After this time period the screw conveyor and the media throwing wheels can be stopped, this unloading process preventing the media from settling in the screws allowing them to restart freely when required during the next blast cleaning cycle. At the next blast cleaning cycle once the screw conveyors or augers are started, the damper (interrupter) in the storage hopper reopens allowing the media to flow as required.

Having thus described my invention what is desired to be secured by letters patented to the United States is set forth in the appended claims.

I claim:

1. A closed system for storing, feeding, recover and recycling blast media recovering from a blast treating chamber operated at cryogenic temperatures for use said blast treating chamber comprising in combination:

a closed storage hopper having a first end adapted to receive new blast media or blast media recycled from said blast treating chamber and a second end adapted to dispense said blast media, said first end of said storage hopper having a generally rectangular first portion extending toward said second end transitioning to a generally trapezoidal second portion extending toward and communicating with, a feeding device comprising at least one auger or screw conveyor mated to said storage hopper to receive said blast media for conveying said blast media to said blast treating chamber;

a baffle disposed in said storage hopper proximate said second end thereof said baffle having a closeable aperture and constructed and adapted to direct blast media to said blast media feeding device; and an electrically actuated pneumatically operated damper to close said aperture in said baffle to prevent media from entering into said feeding device; and a cover removably positioned on said first end of said storage hopper adapted to effect a closed system to prevent ambient atmosphere from entering said hopper and to receive a recycled blast media conduit and media added manually.

* * * * *